United States Patent [19]

Takahashi

[11] Patent Number: 4,778,296

[45] Date of Patent: Oct. 18, 1988

[54] PAPER CHECK DEVICE FOR A PRINTER

[75] Inventor: Kiyoshi Takahashi, Nagoya, Japan

[73] Assignee: Brother Kogyo Kabushiki Kaisha, Aichi, Japan

[21] Appl. No.: 111,664

[22] Filed: Oct. 23, 1987

[30] Foreign Application Priority Data

Oct. 30, 1986 [JP] Japan ..... 61-259290

[51] Int. Cl.[4] ..... B41J 29/46

[52] U.S. Cl. ..... 400/708; 400/568; 400/569; 400/711; 400/712; 400/902

[58] Field of Search ..... 400/708, 708.1, 711, 400/712, 568, 569, 902

[56] References Cited

U.S. PATENT DOCUMENTS

| | | | |
|---|---|---|---|
| 4,014,427 | 3/1977 | Rines | 400/708.1 |
| 4,255,064 | 3/1981 | Kelly | 400/708 |
| 4,277,176 | 7/1981 | Grosvernier | 400/708 X |
| 4,540,299 | 9/1985 | Yamada | 400/708 |

FOREIGN PATENT DOCUMENTS

| | | | |
|---|---|---|---|
| 0177977 | 4/1986 | European Pat. Off. | 400/708 |
| 0033968 | 4/1981 | Japan | 400/708 |
| 0087084 | 5/1983 | Japan | 400/708 |
| 0171679 | 9/1984 | Japan | 400/708 |
| 0002390 | 1/1985 | Japan | 400/708 |
| 0064881 | 4/1985 | Japan | 400/708 |
| 0071284 | 4/1985 | Japan | 400/708 |
| 0002589 | 1/1986 | Japan | 400/708 |

OTHER PUBLICATIONS

IBM Technical Disclosure Bulletin, "Method For Ignoring a Punched Hole in Original Document", KIDA, vol. 24, No. 1B, Jun. 1981, pp. 549–550.

*Primary Examiner*—Ernest T. Wright, Jr.
*Attorney, Agent, or Firm*—Parkhurst, Oliff & Berridge

[57] ABSTRACT

A paper check device for a printer including paper feed means, a light emitter, a light receiver, reflectance determination means, and paper check means. The paper check means determines that a paper is not on the platen when the platen is detected to be moving and a determined reflectance is in a preset range for a time interval longer than another preset value. The paper check device correctly detects whether the paper is on the platen even if the paper with already printed patterns of low reflectance is employed.

4 Claims, 3 Drawing Sheets

PLATEN
M1
PAPER M2
M3
PAPER FEED MEANS
M5
LIGHT RECEIVER
LIGHT EMITTER M4
REFLECTANCE DETERMINATION MEANS
M6
M8
PAPER CHECK MEANS
OUTPUT (ALARM DEVICE)
M7

PAPER CHECK DEVICE FOR A PRINTER

BACKGROUND OF THE INVENTION

1. Field of the Invention

This invention relates to an optical paper check device for a printer for detecting whether a paper is on the platen of the printer.

2. Description of the Prior Art

In a prior art printer, a mechanical paper check device has detected whether a paper is on the platen so as not to directly print on the platen. The mechanical device cannot accurately detect that the paper is on the platen because the detecting position of the paper changes depending on the stiffness of the paper. Thus use of an optical paper check device has been recently proposed. This optical paper check device determines whether a paper is on the platen by the change in reflectance of light spotted on the platen.

However, the paper check device erroneously detects that the paper is not on the platen when the reflectance at the sensed position of a paper is lower than elsewhere. This occurs, for example, when some dark patterns are printed on the paper.

SUMMARY OF THE INVENTION

Accordingly, it is an object of the present invention to provide a paper check device for a printer which detects correctly whether a paper is on the platen even if the paper with already printed patterns or lines of low reflectance is employed.

This object and other related objects are realized by a paper check device of the present invention for the printer whose principle structure is shown in FIG. 1 having a platen M1, including: paper feed means M3 for rotating the platen M1; a light emitter M4 for emitting light toward the platen M1; a light receiver M5 for receiving light reflected from the platen M1 or from a paper M2 on the platen M1; means M6 for determining reflectance of light based on the emitted light and the received light; paper check means M7 for determining that the paper M2 is not on the platen M1 when the platen M1 is being rotated and the determined reflectance is in a preset range for a time interval longer than another preset value; and an alarm device M8 activated by the determination that paper M2 is not on the platen M1.

BRIEF DESCRIPTION OF THE DRAWINGS

The invention will now be described with reference to the accompanying drawings wherein.

DETAILED DESCRIPTION OF PREFERRED EMBODIMENT

An embodiment of the present invention is set forth in detail according to drawings.

Figure 1:
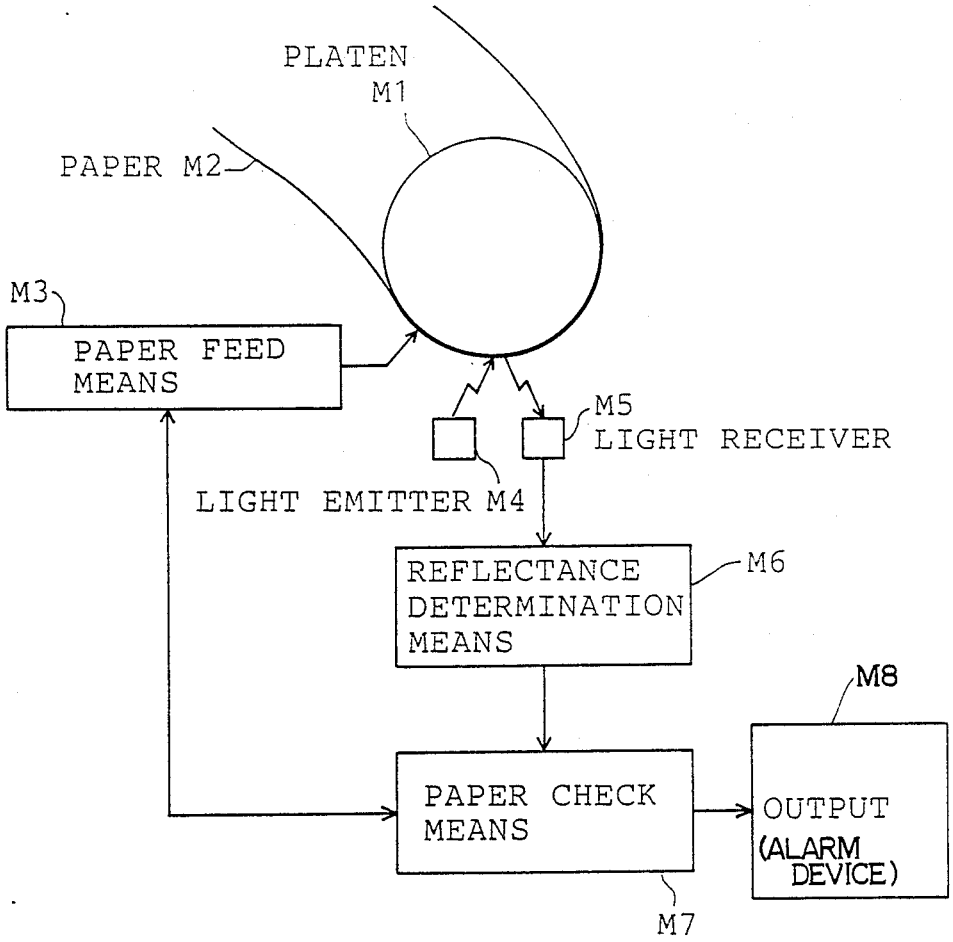
FIG. 1 is a block diagram illustrating a principle structure of the present invention.
Figure 2:
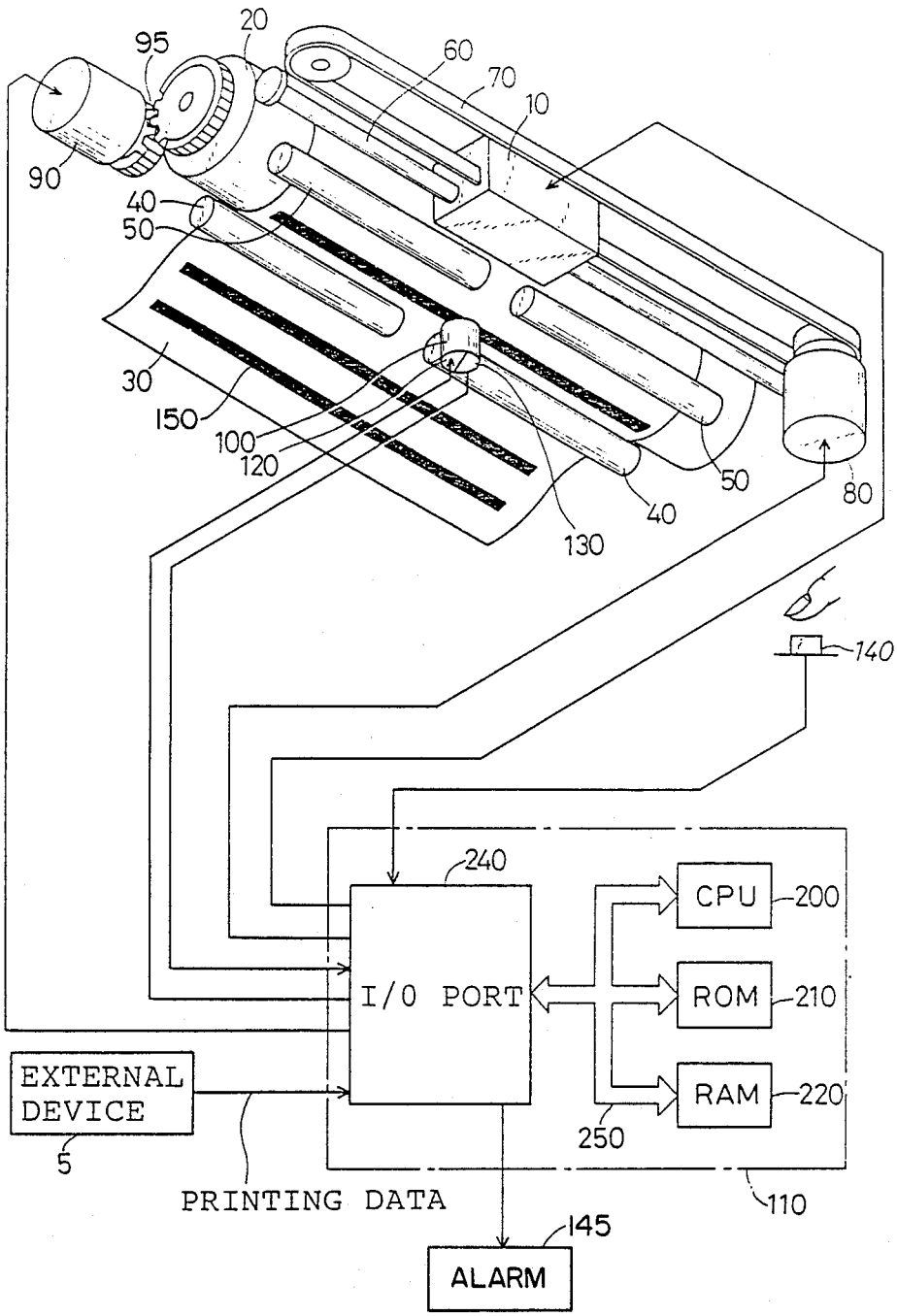
FIG. 2 is a perspective view of the main part of a printer and a block diagram illustrating a schematic structure of the printer as an embodiment of the present invention.

Referring to FIG. 2, printing data input from an external device 5 are printed on a paper 30 by a print head (not shown) attached to a carriage 10 of the printer of the embodiment. The paper 30 is supported by two pairs of rollers 40 and 50 on a platen 20. The platen 20 is made of black rubber. The print head and a printing ribbon (not shown) are installed on the carriage 10 which is slidably supported by a guide rod 60. The carriage 10 is driven by a stepping motor 80 via a belt 70 along the platen 20 to a desired position. One end of the platen 20 is connected with another stepping motor 90 via a gear 95. The platen 20 rotates according to a rotation of the driving motor 90 so as to feed the paper 30. A paper sensor 100 is provided between the rollers 40 and 50 opposite to the platen 20. The sensor 100 is an optical type, and has a light emitting part 120 and a light receiving part 130. Any type of print head such as wire dot type, daisy wheel type, thermal type, or ink jet type can be used in this invention.

Operation of the stepping motors 80 and 90, the carriage 10 and the print head, and detection of the paper 30 by the paper sensor 100 are controlled by an electronic control unit (ECU) 110.

The ECU 110 is provided with CPU 200, ROM 210, RAM 220, an input/output (I/O) port 240, and a bus 250. The I/O port 240 is connected to the print head, the stepping motors 80 and 90, the paper sensor 100, a select switch 140 and the external device 5.

Figure 3:
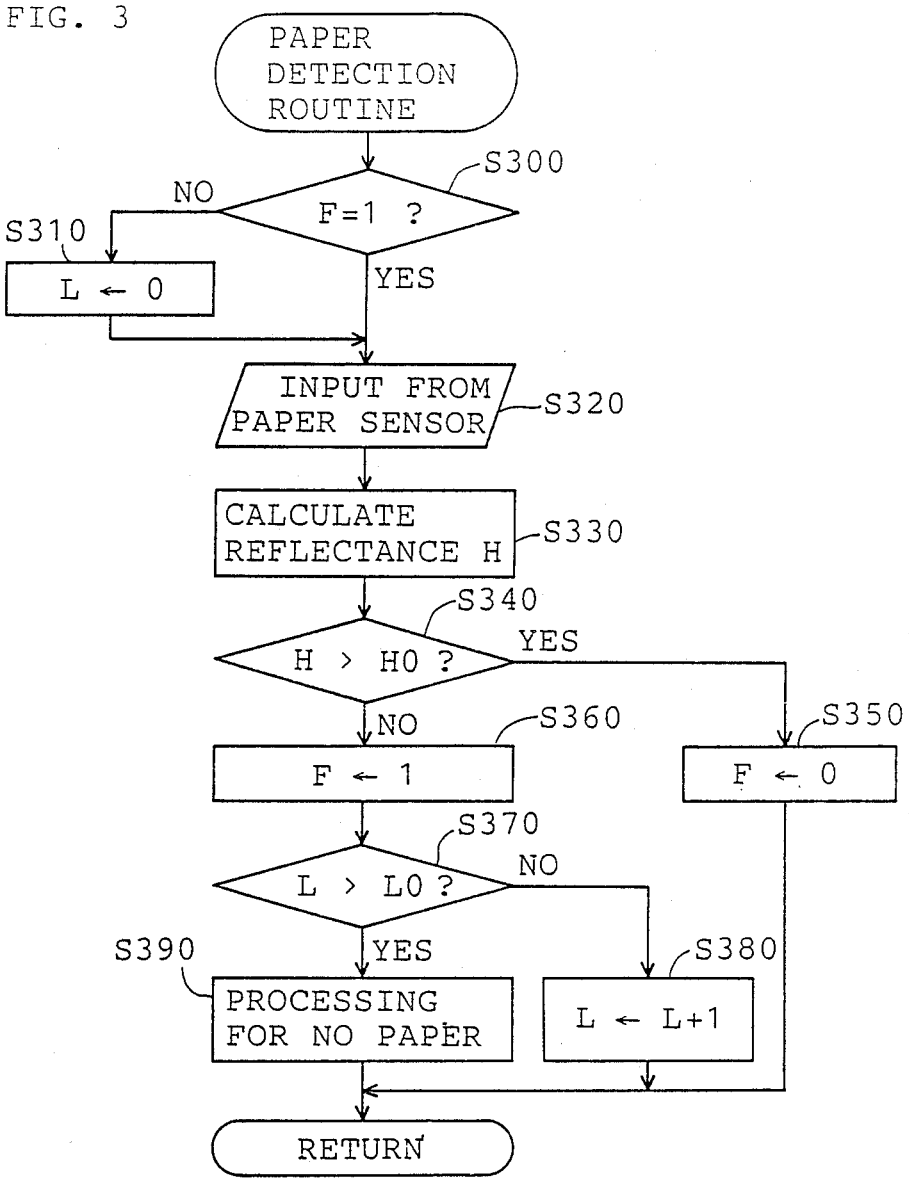
FIG. 3 is a flow chart illustrating a routine executed in the embodiment.

FIG. 3 is a flow chart of a process routine executed by the ECU 110 for detecting whether the paper 30 is on a platen 20. The program of this routine is stored in the ROM 210. The routine is executed when the power to the printer is turned on, the paper 30 is released, the select switch 140 is turned on, or a select command signal is input externally.

When this routine is started, the program is executed from S300 at which it is determined whether a flag F provided in the RAM 220 is 1. The flag F is changed according to the sensed reflectance by execution of the latter part of this routine. That is, the flag F is set at 1 when the reflectance is lower than a preset reference value, and the flag F is set at 0 when the reflectance is higher than the reference value. If the answer is NO at S300, the program proceeds to S310 at which a paper feed counter L provided in the RAM 220 is cleared. If the answer is YES at S300, the program proceeds to S320.

At S320, a signal is input from the light receiver 130 of the paper sensor 100. At S330, reflectance H at the sensing position is calculated based on the signal.

At S340, it is determined whether the reflectance H is higher than the reference value H0. If the answer is YES, it is determined that the paper 30 is at the sensed position. Then the flag F is set at 0 at S350 and the routine ends.

On the other hand, if the answer is NO at S340, the program proceeds to S360 at which the flag F is set at 1. At S370, it is determined whether a value of the paper feed counter L is more than another reference value L0. The value of the counter L represents the feed amount of the paper 30 driven by the platen 20 during $H<H0$ at S340. If the answer is NO, the program proceeds to S380 at which the stepping motor 90 is driven by one step to feed the paper 30 and the value of the counter L is increased by one, then the routine ends.

On the other hand, if the answer is YES at S370, the program proceeds to S390 at which it is determined that the paper 30 is not on the platen 20 and processing for informing the determination result is executed, then the routine ends. Namely, it is determined that the paper 30 is not on the platen 20 when the paper 30 is continued to be fed more than the reference value L0 during H<H0. Accordingly, it is correctly determined that the paper 30 is on the platen 20 even if lines or patterns 150 whose width is less than a preset value determined by L0 are already printed on the paper 30 as shown in FIG. 2. Processing at S390 is, for example, to sound an alarm 145, to light a warning lamp, or to set the printer in a de-select state so as to stop printing.

In this embodiment having the aformentioned structure, an already printed pattern on the paper 30 is not mistaken for the platen 20. Accordingly, it can be correctly determined whether the paper 30 is on the platen 20 even if the paper 30 with patterns is employed. Furthermore, the top and bottom ends of the paper 30 can be accurately sensed because the paper sensor 100 is an optical type which is not influenced by the stiffness of the paper 30. Here, the sensor 100 does not need to be just under the platen 20, but it may be at any position opposing the platen 20. Preferably, though, the paper sensor 100 is positioned at the rollers 50 on the platen 20 because the paper 30 is secured between the platen 20 and the rollers 50 and this position is nearer to the printing position.

While the invention has been particularly shown and described with reference to a preferred embodiment, it will be understood by those skilled in the art that various other changes in form and detail may be made without departing from the spirit and scope of the invention.

What is claimed is:

1. A paper check device for a printer having a platen, comprising:

paper feed means for rotating the platen;

a light emitter for emitting light toward the platen;

a light receiver for receiving light reflected from the platen and from a paper on the platen;

reflectance determination means for determining whether the received reflectance is within a preset range and for determining that the paper is on the platen when the determined reflectance is outside of the preset range; and paper check means for rotating said platen to check a determination of the reflectance determination means that the received reflectance is within the preset range for determining whether a paper is present, said paper check means comprising means for determining that the paper is not on the platen when the platen is being rotated and the received reflectance is within the preset range for a time interval longer than another preset value and for determining that the paper is on the platen when the platen is being rotated and the received reflectance is within the preset range for a time interval shorter than said another preset value.

2. A paper check device according to claim 1, wherein the platen is made of dark material and the reflectance determination means determines whether the received reflectance is lower than a preset value and determines that the paper is on the platen when the determined reflectance is higher than the preset value and the paper check means checks the determination by the reflectance determination means as the platen is being rotated and determines that the paper is not on the platen when the platen is being rotated and the received reflectance is lower than the preset value for a time interval longer than said another present value and determines that the paper is on the platen when the platen is being rotated and the received reflectance is lower than the preset value for the time interval shorter than or equal to said another preset value.

3. A printer comprising a paper check device according to claim 1, wherein the printer further comprises an alarm device which gives off an alarm when the paper check means determines that the paper is not on the platen.

4. A printer according to claim 3, wherein the alarm device sets the printer in a de-select state and stops printing when the paper check means determines that the paper is not on the platen.

* * * * *